US006709088B2

(12) United States Patent
Hayakawa et al.

(10) Patent No.: US 6,709,088 B2
(45) Date of Patent: Mar. 23, 2004

(54) INKJET RECORDING APPARATUS

(75) Inventors: Hitoshi Hayakawa, Nagano-ken (JP); Takahiro Naka, Nagano-ken (JP); Shigenori Fukasawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/836,388

(22) Filed: Apr. 18, 2001

(65) Prior Publication Data

US 2002/0003554 A1 Jan. 10, 2002

(30) Foreign Application Priority Data

Apr. 18, 2000 (JP) ..... 2000-116135
Sep. 12, 2000 (JP) ..... 2000-275965

(51) Int. Cl.[7] ..... B41J 2/165
(52) U.S. Cl. ..... 347/31; 347/35; 347/104
(58) Field of Search ..... 347/104, 31, 36, 347/29, 35, 34, 90, 89

(56) References Cited

U.S. PATENT DOCUMENTS 4,967,204 A * 10/1990 Terasawa et al. ..... 347/35
5,172,140 A * 12/1992 Hirabayashi et al. ..... 347/36
5,896,143 A * 4/1999 Matsui et al. ..... 347/24
5,907,336 A * 5/1999 Hayakawa ..... 347/29
6,345,878 B1 * 2/2002 Kanaya ..... 347/23

FOREIGN PATENT DOCUMENTS

JP 1-127360 5/1989 ..... B41J/3/04
JP 4-235058 8/1992 ..... B41J/2/18
JP 6-79877 3/1994 ..... B41J/2/165
JP 8-169155 7/1996 ..... B41J/19/18
JP 9-52374 2/1997 ..... B41J/2/165

OTHER PUBLICATIONS

Patent Abstract of Japan 04–235058, Aug. 24, 1992.
Patent Abstract of Japan 06–079877, Mar. 22, 1994.
Patent Abstract of Japan 01–127360, May 19, 1989.
Patent Abstract of Japan 09–052374, Feb. 25, 1997.
Patent Abstract of Japan 08–169155, Jul. 02, 1996.

* cited by examiner

*Primary Examiner*—Stephen D. Meier
*Assistant Examiner*—Ly T Tran
(74) *Attorney, Agent, or Firm*—Sughrue Mion, PLLC

(57) ABSTRACT

The recording medium guide member is placed along the main scanning direction scanned by the carriage mounted with a recording head, and ink-receiver holes for receiving ink discharged from the recording head are formed on the guide member in positions beyond the edges of the recording medium being conveyed. Ink absorbing materials are placed in said ink-receiver holes, and a discharged ink accumulating means that cumulatively counts the amount of ink discharged into the ink absorbing materials is provided. The amount of ink discharged into the ink-receiver holes can be controlled by the discharged ink accumulation means so that contamination of the left and right edges or the top and bottom as well as left and right edges of the recording medium, caused by excessive ink collecting in the ink-receiver holes, can be avoided.

16 Claims, 9 Drawing Sheets

| Mode | Ink Amount (gf) | Discharged Liquid Count |
|---|---|---|
| Cleaning 1 | 0.3 | 3000 |
| Cleaning 2 | 3.0 | 30000 |
| Cleaning 3 | 1.2 | 12000 |
| Timer Cleaning | 0.5 | 5000 |
| Margin-Free Printing 1 (Single pass, one hole) | 0.0003 | 3 |
| Margin-Free Printing 2 (1 line) | 0.03 | 300 |

[Fig.6]

| Mode | Ink Amount (gf) | Discharged Liquid Count |
|---|---|---|
| Cleaning 1 | 0.3 | 3000 |
| Cleaning 2 | 3.0 | 30000 |
| Cleaning 3 | 1.2 | 12000 |
| Timer Cleaning | 0.5 | 5000 |
| Margin-Free Printing 1 (Single pass, one hole) | 0.0003 | 3 |
| Margin-Free Printing 2 (1 line) | 0.03 | 300 |

INKJET RECORDING APPARATUS

BACKGROUND OF THE INVENTION

1. Field of the Invention

This invention relates to an inkjet recording device provided with a recording head that is mounted on the carriage and discharges ink based on the printing data; specifically, it relates to an inkjet recording device that allows margin-free printing with no margin on the left and right edges of the recording medium, or full-page margin-free printing with no margin on the top, bottom, left, and right edges of the recording medium.

2. Description of the Related Art

An inkjet recording device that can print with the margins set to zero on both the left and right edges of a recording medium is disclosed in Laid-Open Patent Application No. 8-169155. According to the recording device disclosed in this application, the device is constructed to execute the printing movement by setting the scanning scope of the recording head mounted on the carriage so that the head moves to areas beyond both the left and right edges of the recording medium.

In order to prevent the recording medium guide member from being contaminated by ink discharged beyond the left and right edges of the recording medium, a mesh screen is provided on the surface thereof to pass through ink drops discharged beyond the left and right edges of the recording medium.

Further, an ink recovery means whose movement is interlocked with the carriage movement is provided under the mesh screen to catch ink drops discharged beyond the left and right edges of the recording medium.

According to the above construction, ink that is discharged by the recording head beyond the left and right edges of the recording medium pass through the above mesh screen and is captured by the ink recovery means provided under said screen. This prevents ink drops from reaching the guide member and contaminating it directly, and avoids secondary contamination of the recording medium.

In such a recording device in the prior art as described above, although ink that is discharged from the recording head beyond the left and right edges of the recording medium is passed through the mesh screen and captured, there is a problem in that, when passing through the above mesh screen, some of the ink collides with the framework constituting the mesh screen, thereby splitting into mist and floating as ink mist.

When such ink mist is generated, a problem occurs in that some of this ink mist adheres to the recording medium to directly contaminate the recording medium. Another problem is that other parts of the ink mist would contaminate the drive mechanism of the recording device and cause disorders in the drive action.

In order to eliminate factors for ink mist generation as described above, a construction for a recording device has been proposed by the applicant of this patent application wherein ink-receiver holes for catching ink discharged by the abovementioned recording head are formed on positions on the guide member protruding beyond the left and right edges of the recording medium while at the same time ink absorbing materials are provided in said ink-receiver holes.

According to the above construction, ink drops discharged in areas beyond the left and right edges of the recording medium strike the porous ink absorbing material provided in the ink-receiver holes and are captured and absorbed by said absorbing material without generating ink mist.

If the abovementioned left and right margin-free printing is used frequently, a large amount of ink accumulates in the porous ink absorbing materials placed inside the ink-receiver holes so that a limit to the ink absorbing capability of the ink absorbing material is reached. When such a limit to the ink absorbing capability occurs, ink collects on top of the ink absorbing material, causing the left and right edges of the recording medium to be contaminated.

In the meantime, an inkjet recording device that can not only eliminate margins on the left and right edges as described above but also execute full-page margin-free printing with no margin on the top, bottom, left, and right edges has been proposed by the applicant of this application.

When performing margin-free printing also on the top and bottom of the paper, ink-receiver holes for ink discharged from the abovementioned recording head need to be formed in the longitudinal direction of the guide member, in other words continuously in the main scanning direction of the recording head, in positions of the recording medium guide member where the top and bottom edges of the conveyed recording medium pass.

In this case, if margin-free printing on the top and bottom as well as left and right if used frequently, a large amount of ink similarly accumulates in the porous ink absorbing materials placed inside the ink-receiver holes so that a limit to the ink absorbing capability of the ink absorbing material is reached. When such a limit to the ink absorbing capability occurs, ink collects on top of the ink absorbing material, causing not only the top and bottom as well as the left and right edges of the recording medium to be contaminated, but also the entire reverse side of the recording medium.

SUMMARY OF THE INVENTION

This invention is intended to resolve the technical problems described above and has the purpose of providing an inkjet recording device that is constituted to control the amount of ink discharged in areas beyond the left and right edges of the recording medium so that it can effectively prevent the recording medium being contaminated by ink, as described above.

Another purpose of this invention is to provide an inkjet recording device that is constituted to control the amount of ink discharged beyond the top and bottom edges as well as the left and right edges of the recording medium so that it can, in a similar fashion, effectively prevent the recording medium being contaminated by ink.

In the first embodiment of the inkjet recording device according to this invention, constituted to achieve the above purposes, the device is provided with a recording head that is mounted on the carriage and which discharges ink based on the printing data, and a recording medium guide member that is placed along the main scanning direction scanned by said carriage and which conveys the recording medium in a subsidiary scanning direction orthogonal to the main scanning direction. The device is constituted so that ink-receiver holes for receiving ink discharged from the abovementioned recording head are formed on the abovementioned recording medium guide member in positions beyond the edges of the recording medium being conveyed, while ink absorbing materials are placed in said ink-receiver holes and a discharged liquid accumulating means that cumulatively counts the amount of ink discharged into said ink absorbing materials are provided.

In the second embodiment of the inkjet recording device according to this invention, constituted to achieve the above purposes, the device is provided with a recording head that is mounted on the carriage and which discharges ink based on the printing data, and a recording medium guide member that is placed along the main scanning direction scanned by said carriage and which conveys the recording medium in a subsidiary scanning direction orthogonal to the main scanning direction. The device is constituted so that ink-receiver holes for receiving ink discharged from the abovementioned recording head are formed on the abovementioned recording medium guide member in positions beyond the left and right edges of the recording medium being conveyed as well as in positions where the top and bottom edges of the recording medium being conveyed pass, while ink absorbing materials are placed in said ink-receiver holes and a discharged liquid accumulating means that cumulatively counts the amount of ink discharged into said ink absorbing materials are provided.

The recording device in either of the abovementioned first embodiment and the second embodiment is preferably constituted so that the discharged liquid accumulating means, which cumulatively counts the amount of ink discharged into the ink absorbing materials in the abovementioned ink-receiver holes, executes a cumulative count for each pass action of the abovementioned carriage.

Further, the device is preferably constituted so that a predetermined specified value is cumulatively counted for each pass action of the abovementioned carriage.

Alternatively, the device is constituted so that the discharged liquid accumulating means, which cumulatively counts the amount of ink discharged into the ink absorbing materials in the abovementioned ink-receiver holes, executes a cumulative count when the recording medium is ejected.

In another alternative, the device is constituted so that the discharged liquid accumulating means, which cumulatively counts the amount of ink discharged into the ink absorbing materials in the abovementioned ink-receiver holes, executes a cumulative count when the power source to the recording device is shut down.

Whichever of the constitutions described above is adopted, the device is preferably constituted so that the abovementioned discharged liquid accumulating means, when cumulatively counting the amount of ink discharged into the ink absorbing materials in the ink-receiver holes, cumulatively counts a specified value predetermined according to the size of the recording medium to be printed.

In the preferred embodiment, the device is further provided with an accumulation determining means which verifies that the value counted by the discharged liquid accumulating means, which cumulatively counts the amount of ink discharged into the ink absorbing materials in the abovementioned ink-receiver holes, and is constituted so that it can be switched to a printing mode that does not discharge ink into the ink-receiver holes when the accumulation determining means verifies that the abovementioned specified value has been reached.

Moreover, the device is preferably constituted so that a message is displayed on the display means when it is verified that the value counted by the discharged liquid accumulating means, which cumulatively counts the amount of ink discharged into the ink absorbing materials in the abovementioned ink-receiver holes, has reached the specified value.

In the gravitational direction below the ink-receiver holes formed on the abovementioned recording medium guide member, a discharged liquid absorbing material is preferably placed to absorb and retain discharged ink from the capping means, which seals the nozzle-forming surface of the recording head and provides negative pressure by means of a suction pump, and constituted so that ink discharged into the abovementioned ink-receiver holes can migrate to said discharged liquid absorbing material.

In this case, it is desirable that a discharged liquid accumulating means be provided that counts by adding together the amount of ink discharged into the ink absorbing material in the ink-receiver holes formed on the abovementioned recording medium guide member and the amount of discharged liquid absorbed by the abovementioned discharged liquid absorbing material.

Additionally, the device is preferably constituted so that a message is displayed on the display means when it is verified that the value counted by the discharged liquid accumulating means, that counts by adding together the amount of ink discharged into the ink absorbing material in the abovementioned ink-receiver holes and the amount of discharged liquid absorbed by the abovementioned discharged liquid absorbing material, has reached the specified value.

If the above constitution is adopted, a construction whereby the ink absorbing materials contained in the abovementioned ink-receiver holes are integrally formed with the discharged liquid absorbing material, which absorbs and retains the discharged ink from the capping means, is preferably utilized.

According to the first embodiment of the inkjet recording device constituted as described above, ink absorbing materials are placed in the ink-receiver holes formed on the recording medium guide member; thus, ink discharged in areas beyond the left and right edges of the recording medium is captured and absorbed by the porous ink absorbing materials placed in the ink-receiver holes.

Also, according to the second embodiment of the inkjet recording device, ink absorbing materials are similarly placed in the ink-receiver holes formed on the recording medium guide member; thus, ink discharged in areas beyond the left and right edges of the recording medium, as well as ink discharged in positions where the top and bottom edges of the recording medium being conveyed pass, is captured and absorbed by the porous ink absorbing materials placed in the ink-receiver holes.

In either the first or second embodiment of the recording device, the amount of ink discharged toward the ink absorbing materials is cumulatively counted by the discharged liquid accumulating means. Therefore, the amount of ink discharged to the ink absorbing material may be grasped by the value counted by the abovementioned discharged liquid accumulating means.

Further, the discharged liquid accumulating means may execute a cumulative count for each carriage pass action, when the recording medium is ejected, or when the power source to the recording device is shut down, and can be constituted in such cases to utilize respectively the control signals generated at each shifting action of the carriage, the control signals generating when the recording medium is ejected, or the control signals when the power source is shut down, so that the discharged liquid accumulating means will cumulatively count a predetermined constant.

The cumulative count of the discharged amount may be more rationally executed by a constitution whereby the abovementioned specified value may be selected according to the size of the recording medium to be printed.

In the first embodiment of the recording device, therefore, when the accumulation determining means verifies that the value counted by the abovementioned discharged liquid accumulating means has reach the specified value, the discharge of ink to the ink-receiver holes may be restricted by switching to a printing mode that does not discharge ink to the ink-receiver holes, such as a normal printing mode with margins on the left and right sides of the recording medium, or by providing control so that ink is not discharged in areas beyond the left and right sides of the recording medium. Through this, contamination of the left and right edges of the recording medium with ink can be avoided.

Also in the second embodiment of the recording device, when the accumulation determining means verifies that the value counted by the abovementioned discharged liquid accumulating means has reach the specified value, the discharge of ink to the ink-receiver holes may be similarly restricted by switching to a printing mode that does not discharge ink to the ink-receiver holes, such as a normal printing mode with margins on the top and bottom as well as left and right sides of the recording medium, or by providing control so that ink is not discharged in areas beyond the top and bottom as well as left and right sides of the recording medium. Through this, contamination of the left and right edges of the recording medium with ink can be avoided.

When the accumulation determining means verifies that the abovementioned counted value has reached the specified value in either the first embodiment or the second embodiment of the recording device, the user may be notified that maintenance is required on the ink absorbing materials contained in the ink-receiver holes by having a message displayed on the display means.

Further, if the device is constructed to have a discharged liquid absorbing material, which absorbs and retains discharged ink from the capping means, placed in the gravitational direction below the ink-receiver holes formed on the recording medium guide member so that discharged ink absorbed by the ink absorbing materials placed in the ink-receiver holes can drop through gravity to the discharged liquid absorbing material, the amount of left and right margin-free printing and top and bottom as well as left and right margin-free printing on the recording medium may be greatly increased.

In this case also, the accumulated amount of discharged ink, primarily in the discharged liquid absorbing material, may be grasped by providing a discharged liquid accumulating means that counts by adding together the amount of ink discharged to the ink absorbing materials in the ink-receiver holes formed on the recording medium guide member and the amount of discharged ink absorbed by the abovementioned discharged liquid absorbing material.

When the accumulation determining means verifies that the abovementioned counted value has reached the specified value, the user may be notified that maintenance is required on the discharged liquid absorbing material by having a message displayed on the display means. In addition, the maintenance work may be facilitated by forming the ink absorbing materials contained in the ink-receiver holes integrally with said discharged liquid absorbing material.

BRIEF DESCRIPTION OF THE DRAWINGS

FIG. 6 is a map diagram describing the relationship between the discharged liquid count and the action modes used in the control circuit shown in FIG. 5.

DETAILED DESCRIPTION OF PREFERRED EMBODIMENTS

Figure 1:
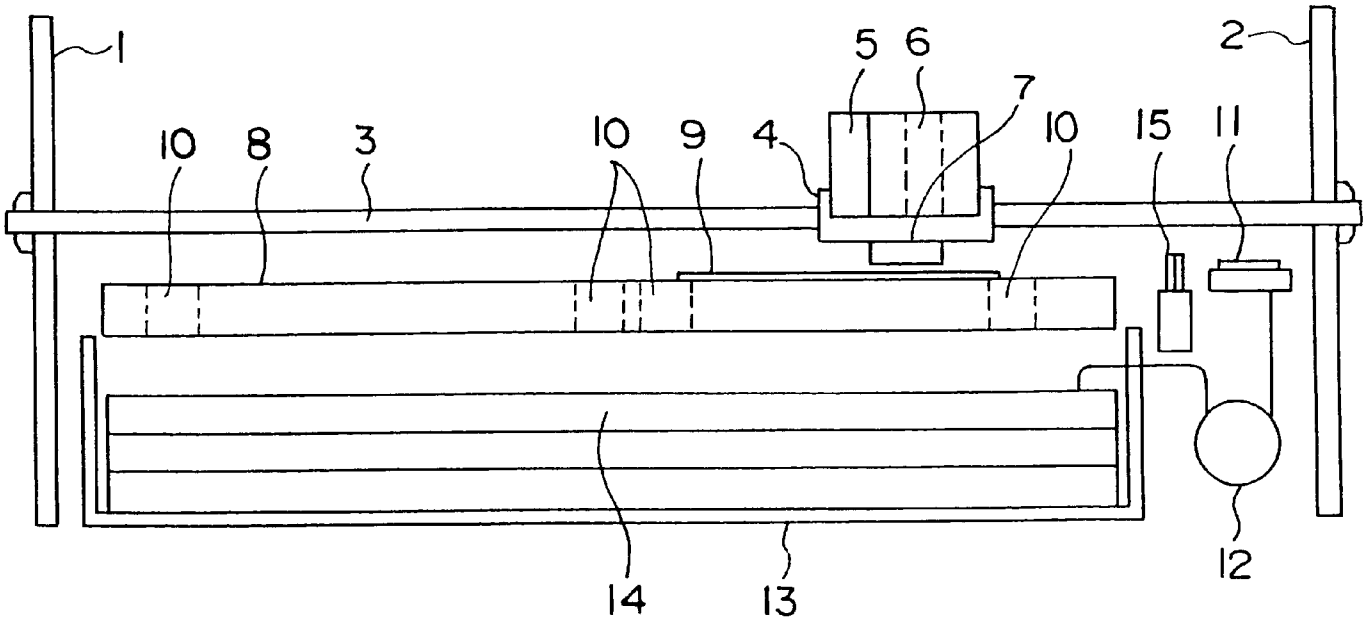
FIG. 1 is a partially broken front view showing a working example of the first embodiment of the inkjet recording device relating to this invention.

The first and second embodiments of the inkjet recording device related to this invention are described below based on working examples illustrated in the drawings. FIG. 1 illustrates the overall construction of the first embodiment of the inkjet recording device; this recording device is so constituted that the carriage 4 is movable in the left and right direction in the drawing, in other words in the main scanning direction, by means of the guide shaft 3 supported by frames 1, 2 to the left and right.

A black ink cartridge 5 and a color ink cartridge 6 are attached detachably to the upper surface of the carriage 4 and constructed so that either ink is supplied to the recording head 7 similarly attached to the lower surface of the carriage 4.

Beneath the recording head 7 in the scanning direction, a guide member 8 for the recording medium is placed corresponding to the scanning direction and is constructed so that recording paper 9, which is the recording medium, placed on the guide member 8 can be conveyed in a subsidiary scanning direction that is orthogonal to the scanning direction of the recording head 7. As described in detail below, a plurality of ink-receiver holes 10 are formed to catch ink drops discharged from the recording head when executing margin-free printing.

The element 11 in the drawing denotes a capping means placed in the non-printing area (home position). This capping means 11 is constructed to rise and seal the nozzle-forming surface of the recording head 7 when the recording head 7 shifts to a position directly above. A suction pump 12 is placed below the capping means 11 to provide negative pressure to the internal cavity of the capping means 11.

In addition to functioning as a lid to prevent the nozzle aperture of the recording head 7 from drying while the recording device is idling, the above capping means 11 also functions as a cleaning means to recover the discharge capability for ink from the recording head by applying the negative pressure from the above suction pump 12 to the recording head 7 and sucking out ink from the recording head 7.

The ink emitted into the capping means 11 by executing the above cleaning means is sent by the suction pump 12 to a discharged liquid tank 13 placed at the bottom of the device where it is absorbed and retained by a discharged liquid absorbing material 14 comprising a porous member housed within the discharged liquid tank 13.

As shown in the drawing, the discharged liquid tank 13 is formed in a size that approximately covers the entire area in the longitudinal direction of the guide member 8, and the discharged liquid absorbing material 14 is also formed to approximately fill the inner capacity of the discharged liquid tank 13.

A wiping member 15 comprising a rubber material molded in strips is placed adjacent to the capping means 11 on the printing area side and is constructed to execute a wiping action to wipe the nozzle-forming surface of the recording head 7 as needed while the carriage 4 reciprocates to and from the capping means 11.

Figure 2:
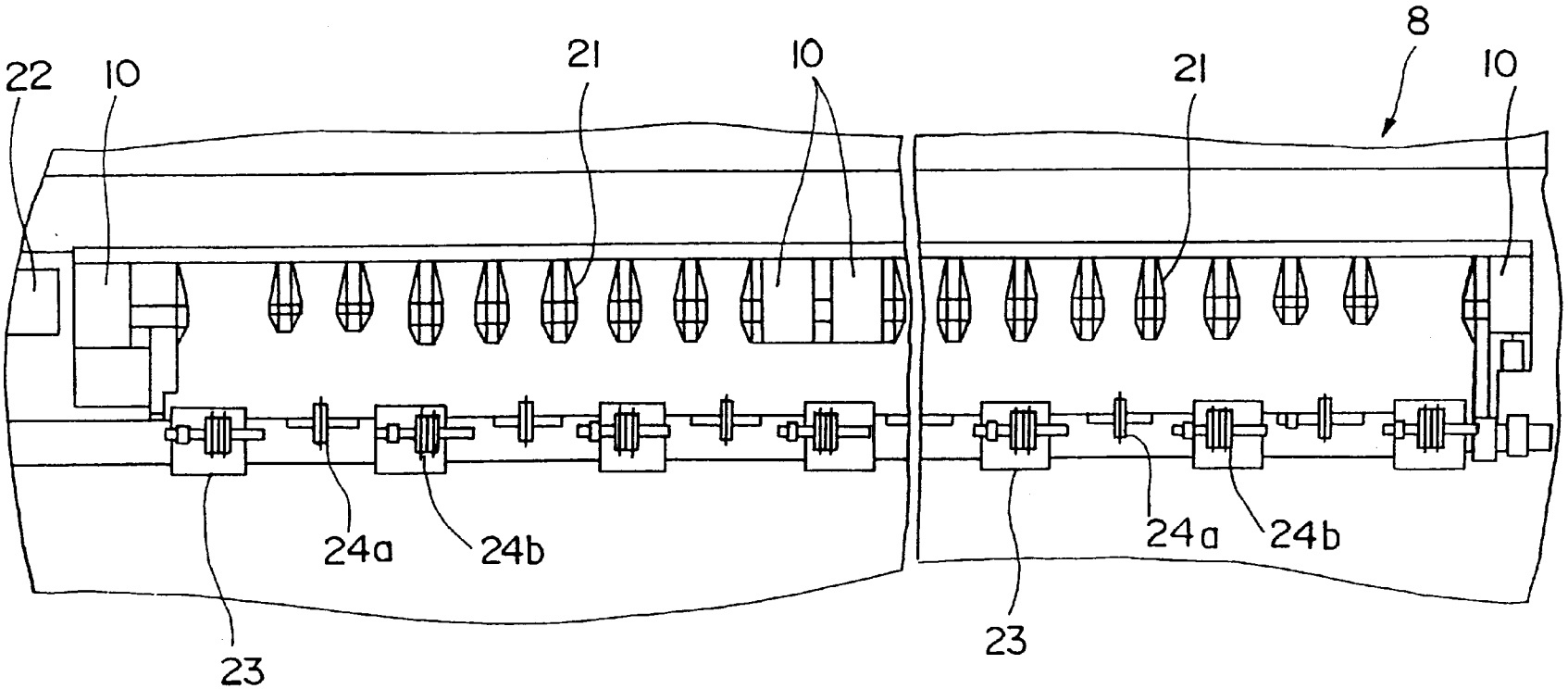
FIG. 2 is a top view showing the construction of the recording medium guide member used in the recording device shown in FIG. 1.
Figure 3:
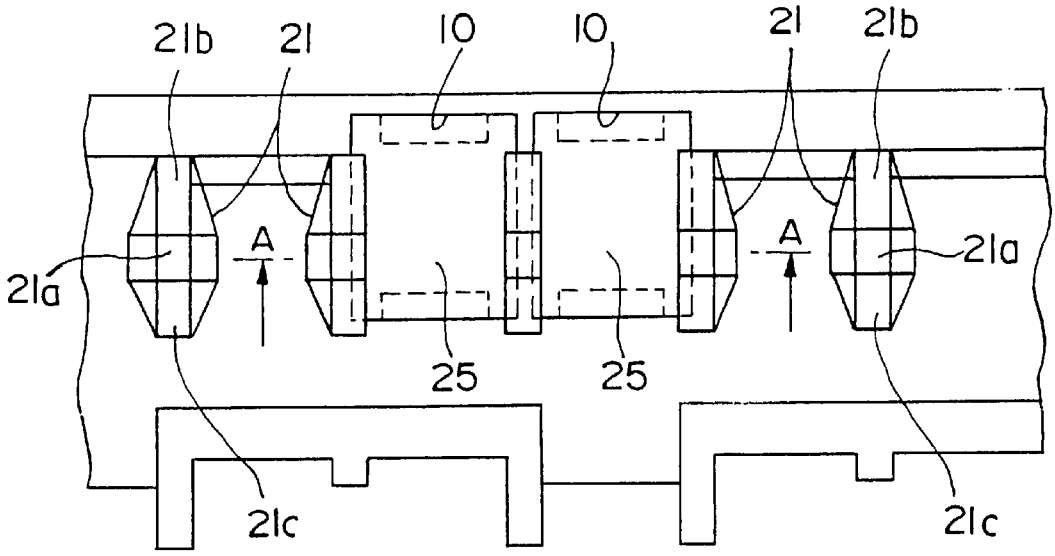
FIG. 3 is a partially enlarged top view of the guide member shown in FIG. 2.
Figure 4:
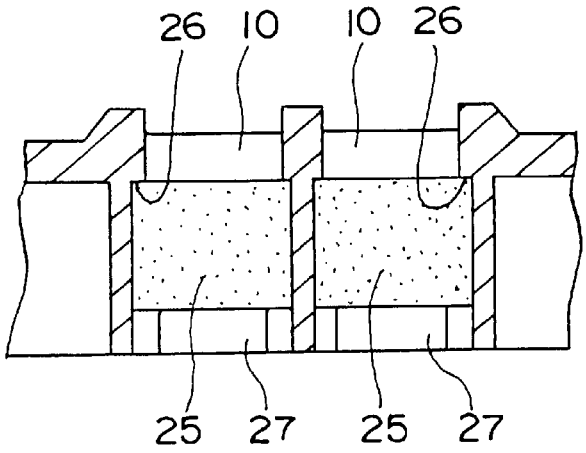
FIG. 4 is a cross-sectional view of the line A—A in FIG. 3 viewed in the direction of the arrow.

FIG. 2 through FIG. 4 illustrate the construction of the abovementioned guide member 8 for the recording medium. FIG. 2 shows a plan view of the guide member 8 in its entirety. FIG. 3 shows the guide member 8 partially enlarged, and FIG. 4 shows the cross-sectional view of the line A—A in FIG. 3 viewed in the direction of the arrow.

As described above, a plurality of ink-receiver holes 10 are formed on the recording medium guide member 8 to catch ink discharged by the recording head during margin-free printing.

A plurality of protrusions 21 is positioned along the main scanning direction on the upper surface of the guide member 8. These protrusions 21 are shaped to be long-length along the direction in which the recording paper is conveyed. A flat apex surface 21*a* is formed on each of the protrusions 21 so that a specific paper gap is formed between the aforementioned recording head 7 and the recording paper conveyed on these flat apex surfaces 21*a* in the subsidiary scanning direction.

With the apex surface 21*a* in the center, each of the aforementioned protrusions 21 has an upstream inclined surface 21*b* and a downstream inclined surface 21*c* formed along the direction in which the recording paper is conveyed. Through this, the tip of the recording paper conveyed from the upstream side is guided to scan, while in contact with the upstream inclined surface 21*b,* over the apex surface 21*a*.

When executing margin-free printing, the right edge of the rolled paper is set with the base position being the abovementioned ink-receiver hole 10 shown in FIG. 2 formed on the home position side (right side in the drawing). The positions of the other ink-receiver holes 10A are determined by the left edge of the recording paper, depending on the size of the paper width, bordering on said ink-receiver holes.

In this working example, an ink-receiver hole 22 is formed on the left edge in FIG. 2 to catch ink drops discharged from the recording head 7 when a flushing action is performed.

Drive rollers 23 are positioned along the longitudinal direction on the upper surface of the guide member 8; two types of driven rollers 24*a*, 24*b*, which rotate in contact with the drive rollers 23, are provided.

These drive rollers and driven rollers constitute the paper ejecting roller unit, which is constructed to pinch and eject the recording paper being conveyed along the upper surface of the guide member 8.

In this working example, each ink-receiver hole 10 is formed, as shown in FIG. 4, to penetrate the guide member 8 in the vertical direction, and an ink absorbing material 25, formed from a foamed material such as urethane and the like, is housed therein.

A profiled section 26 is formed on the upper part in the interior of each ink-receiver hole 10 while a pair of protrusions 27 is formed on the facing lower part in the interior of each ink-receiver hole 10. The profiled section 26 and the pair of protrusions 27 are so constructed to retain the abovementioned ink absorbing material 25 in the ink-receiver hole 10.

Through this construction, ink discharged in areas beyond the left and right edges of the recording medium when executing margin-free printing will fly toward the ink-receiver hole positioned on the home position side and another ink-receiver hole determined by the size of the recording paper. Since each ink-receiver hole houses an ink absorbing material 25, the ink drops are captured and absorbed by said absorbing material to prevent ink mist being generated.

Figure 5:
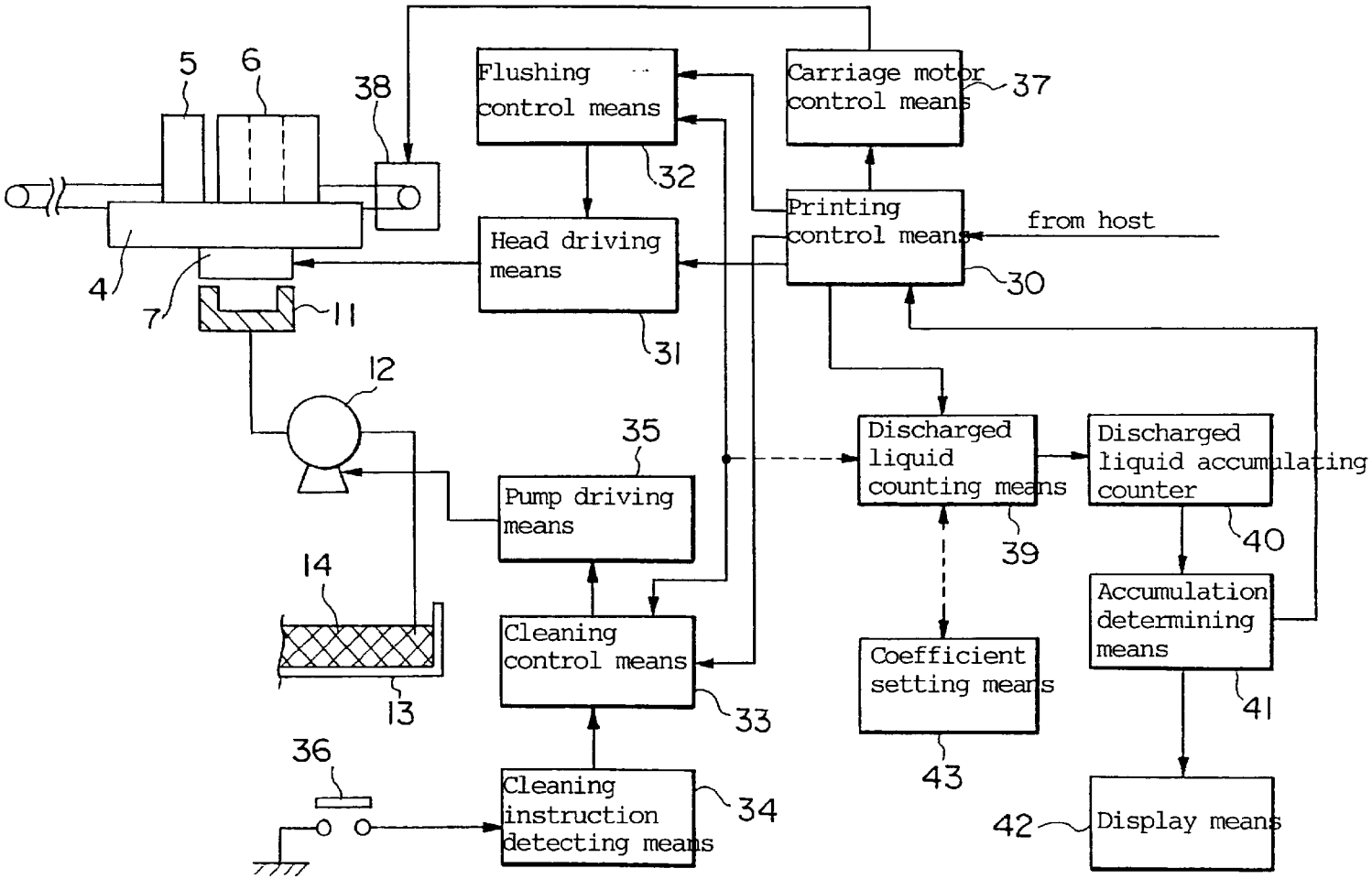
FIG. 5 is a block diagram showing an example of a control circuit that can count the amount of ink discharged into the ink-receiver holes when margin-free printing is performed.

FIG. 5 illustrates an example of a control circuit installed on the recording device having the construction described above and capable of counting the amount of ink discharged to each ink-receiver hole on the guide member when margin-free printing is performed. In FIG. 5, elements already described are shown by the same number and duplicated explanations are therefore omitted.

In the abovementioned working example, each ink-receiver hole 10 formed on the guide member 8 penetrates the guide member in the vertical direction; thus discharged ink that cannot be absorbed and retained by the ink absorbing material 25 housed in each ink-receiver hole drops to the discharged liquid absorbing material 14 housed in the discharged liquid tank 13 placed below.

However, there are cases where the ink-receiver holes do not penetrate the guide member in the vertical direction but are in closed-bottom form. In the following, the process of cumulatively counting the discharged ink assuming that each ink-receiver hole is in closed-bottom form is explained first, then the process of cumulatively counting the discharged ink when each ink-receiver hole penetrates the guide member in the vertical direction is explained.

In FIG. 5, 30 is a printing control means. This printing control means 30 is provided with the function of generating bit map data based on printing data from the host computer and causing drive signals, based on the data, to be generated from the head driving means 31 so that ink will be discharged from the recording head 7 mounted on the carriage 4.

In addition to the drive signals based on printing data, the head driving means 31 is also constituted to receive flushing instruction signals from the flushing control means 32 and to output drive signals for a flushing operation to the recording head 7.

The element 33 is the cleaning control means. This cleaning control means 33 is provided with the function of receiving control signals from the cleaning instruction detecting means 34 to control the pump driving means 35 and activate the suction pump 12.

By operating the cleaning instruction switch 36 placed on the operating panel and the like on the recording device, the abovementioned cleaning instruction detecting means 34 is activated so that the cleaning operation can be performed manually.

The cleaning control means 33 is also constituted to receive control signals from the printing control means 30 and is provided thereby with operating functions for timer cleaning and the like, which similarly activates the suction pump 12 by controlling the pump driving means 35.

In the meantime, control signals are sent from the abovementioned printing control means 30 to the carriage motor control means 37; drive signals are sent from the carriage motor control means 37 to the carriage motor 38 to perform the abovementioned margin-free printing and the like.

In this case, the size of the cut paper or the rolled paper is input on the printer driver utility loaded in the host computer; based on this, instruction signals are sent from the printing control means 30 to the carriage motor control means 37 for the carriage to perform main scanning over a range that slightly exceeds the specified paper width.

Control signals are sent from the abovementioned printing control means 30 to the discharged liquid counting means 39 so that the amount of ink discharged during margin-free printing to each ink-receiver hole 10 formed on the guide member 8 is counted individually.

The value counted by the discharged liquid counting means 39 is sent to the discharged liquid accumulating counter 40 that constitutes the discharged liquid accumulating means, said counter cumulatively counting the amount of ink discharged into each ink-receiver hole 10 individually.

In this working example, the abovementioned discharged liquid counting means 39 counts the amount of ink discharged into each ink-receiver hole 10 for each pass action of the carriage and sends the count for each pass action sequentially to the discharged liquid accumulating counter 40. In this case, a discharged ink count that is sufficiently satisfactory for practical purposes can be achieved if a constant predetermined for each pass action is sent by the discharged liquid counting means 39 to the discharged liquid accumulating counter 40.

The abovementioned discharged liquid accumulating counter 40 sends the count to the accumulation determining means 41. The accumulation determining means 41 verifies whether or not the discharged ink count discharged into each ink-receiver hole has reached a specified value.

If it is determined that the quantity of discharged ink discharged to any ink-receiver hole has reached a specified value, control signals are sent from the accumulation determining means 41 to the display means 42 and the printing control means 30.

In this case, the abovementioned display means 42 displays a message recommending maintenance such as replacing the ink absorbing materials housed in the ink-receiver holes. Also, the printing control means 30 receives instructions from the accumulation determining means 41 to switch the printing mode so that ink is not discharged into the ink-receiver holes.

In such a case, control is provided so that for example a normal printing mode with margins on the left and right sides of the recording paper is adopted. Or control could be provided so that ink is not discharged in the areas beyond the left and right edges of the recording medium.

The discharge of ink to the ink absorbing materials housed in each ink-receiver hole can be limited by this means. Thus, contamination of the left and right edges of the recording paper by ink, caused by excessive discharged ink collected in the ink-receiver holes, can be avoided.

The data from the abovementioned discharged liquid accumulating counter 40 can also be utilized by editing on the printer driver in the host computer to display the number of sheets that can be printed in margin-free printing.

The above explanation assumes that the ink-receiver holes are in closed-bottom form. Next, the cumulative counting process for discharged ink when the ink-receiver holes penetrate the guide member in the vertical direction, as shown in FIG. 4, is explained. In this case, the constitution is such, as shown in FIG. 5, that control signals are sent from the cleaning control means 33 to the discharged liquid counting means 39 in the control block, and a count setting means 43 is connected to the discharged liquid counting means 39.

The above count setting means 43 receives control signals from the cleaning control means 33 and the printing control means 30 to derive the discharged liquid count in accordance with each action mode shown in FIG. 6 for example. In other words, a map describing the relationship between each action mode as shown in FIG. 6 and the discharged liquid count is stored in the count setting means 43.

"Cleaning 1" in FIG. 6 shows the constant for discharged ink drained into the discharged liquid absorbing material 14 in the discharged liquid tank 13 when a manual cleaning operation is executed by the user operating the cleaning instruction switch 36 to activate the cleaning instruction detecting means 34. "Cleaning 2" shows the constant for discharged ink drained into the discharged liquid absorbing material 14 in the discharged liquid tank 13 when an initial loading cleaning, performed when first introducing ink into the recording device, is executed.

When this initial loading cleaning is being executed, the exchange fluid filled within the ink path reaching the recording head is completely drained and the new ink is loaded so that the amount of discharged liquid is extremely large and the discharged liquid count is therefore also large.

"Cleaning 3" shows the constant for discharged ink drained into the discharged liquid absorbing material 14 in the discharged liquid tank 13 in a replacement cleaning operation when an ink cartridge is replaced for example. "Timer Cleaning" is performed on a regular basis to eject ink in the recording head whose viscosity has increased after a specific duration and the constant shown is for discharged ink drained in this situation into the discharged liquid absorbing material 14 in the discharged liquid tank 13.

"Margin-Free Printing" shows the constant for discharged ink discharged into the ink-receiver holes 10 formed, as described above, on the guide member 8; the value for a single pass is shown. "Margin-Free Printing 2" in FIG. 6 is utilized when executing top and bottom margin-free printing described below.

When the abovementioned discharged liquid counting means 39 receives control signals from the cleaning control means 33, it accesses the table configured in the count setting means 43 based on the cleaning modes, reads the discharged liquid count corresponding to the cleaning mode, and sends out the count to the discharged liquid accumulating counter 40.

When the above discharged liquid counting means 39 receives control signals from the printing control means 39, it reads the count corresponding to the above "Margin-Free Printing" and sends the count out to the discharged liquid accumulating counter 40. In this case, therefore, the discharged liquid accumulating counter 40 calculates by adding up the amount of ink discharged into each ink-receiver hole 10 formed on the guide member and the amount of discharged liquid absorbed by the discharged liquid absorbing material 14 through cleaning operations.

The threshold value at which the discharged liquid absorbing material 14 in the discharged liquid tank 13 is filled with discharged ink is set in the accumulation determining means 41 to verify whether or not the discharged ink count has reached a specified value (threshold value). When it is determined that the count has reached the specified value, control signals are sent from the accumulation determining means 41 to the display means 42 to display a message recommending maintenance such as replacing the discharged liquid absorbing material 14, or replacing, as needed, the ink absorbing materials housed in the ink-receiver holes.

Figure 7:
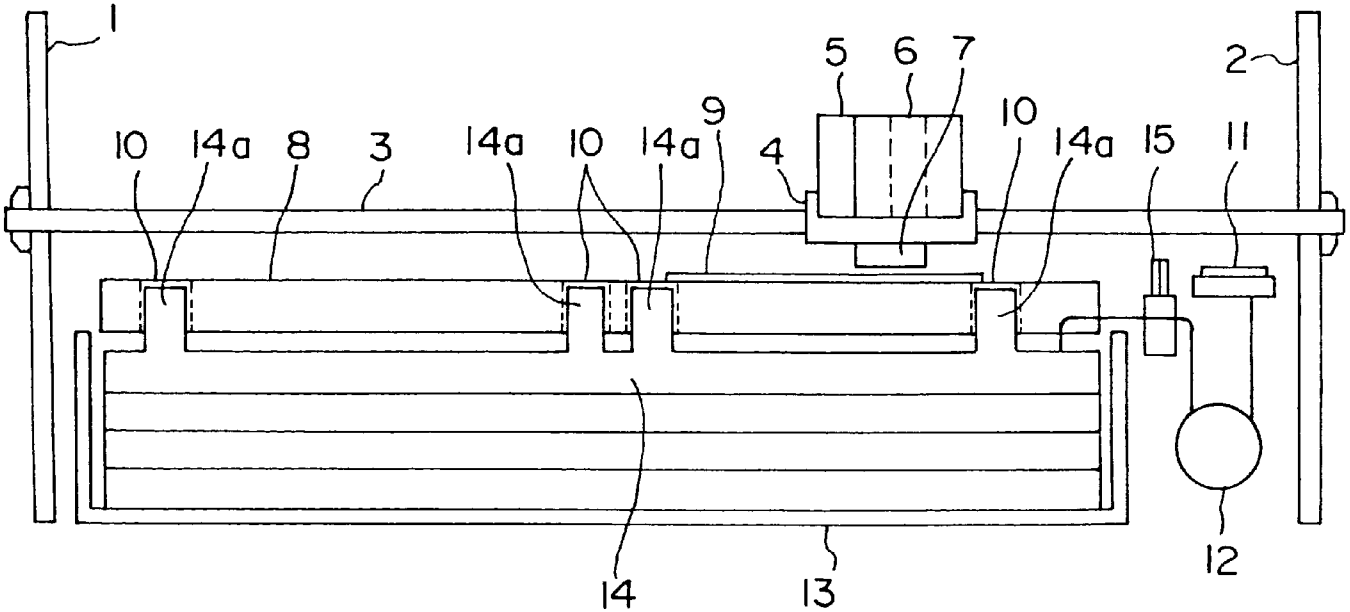
FIG. 7 is a partially broken front view of the first embodiment of the recording device with improvement to the form of the discharged liquid absorbing material.

FIG. 7 shows an improvement in the form of the discharged liquid absorbing material of the recording device in the abovementioned first embodiment. In this example, the ink absorbing material housed in each ink-receiver hole 10 is formed integrally with the discharged liquid absorbing material 14 that absorbs and retains discharged ink from the capping means.

In other words, columnar protrusions 14*a* are formed integrally on the uppermost layer of the discharged liquid absorbing material in positions corresponding to the ink-receiver holes 10. According to this construction, ink is absorbed by the columnar protrusions 14*a* and migrates in the gravitational direction to be retained by the discharged liquid absorbing material 14 when margin-free printing is executed.

Thus, according to this construction, the amount of margin-free printing that can be executed to the left and right of the recording paper is greatly increased. Also according to the construction shown in FIG. 7, the absorbing materials housed in the ink-receiver holes 10 can be maintenanced at the same time as maintenance on the discharged liquid absorbing material 14, facilitating the maintenance operation.

As is clear from the description above, the first embodiment of the inkjet recording device according to this invention has ink-receiver holes formed for ink discharged from the recording head during margin-free printing, as well as ink absorbing materials placed in said ink-receiver holes; it is further provided with a discharged liquid accumulating means to accumulate and count the amount of ink discharged into the ink absorbing materials so that the amount of discharged ink accumulated in the ink-receiver holes can be controlled. Thus, the problem of excessive discharged ink collecting in the ink-receiver holes and contaminating, for example, the left and right edges of the recording medium can be avoided.

Figure 8:
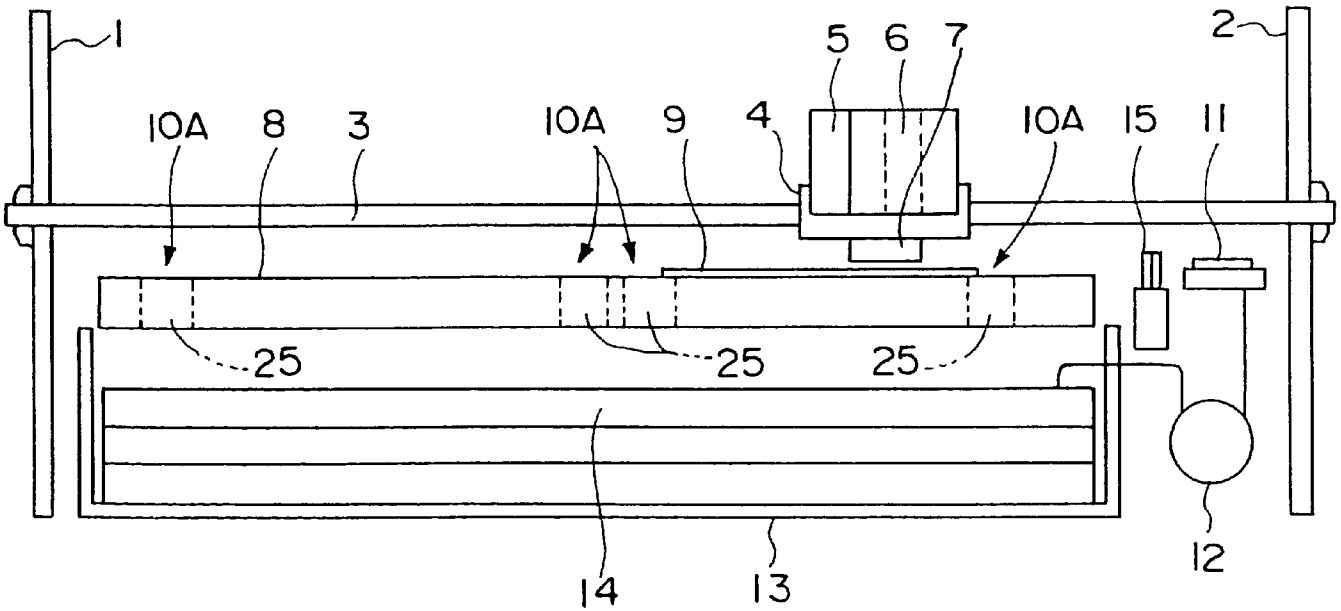
FIG. 8 is a partially broken front view showing a working example of the second embodiment of the inkjet recording device relating to this invention.
Figure 9:
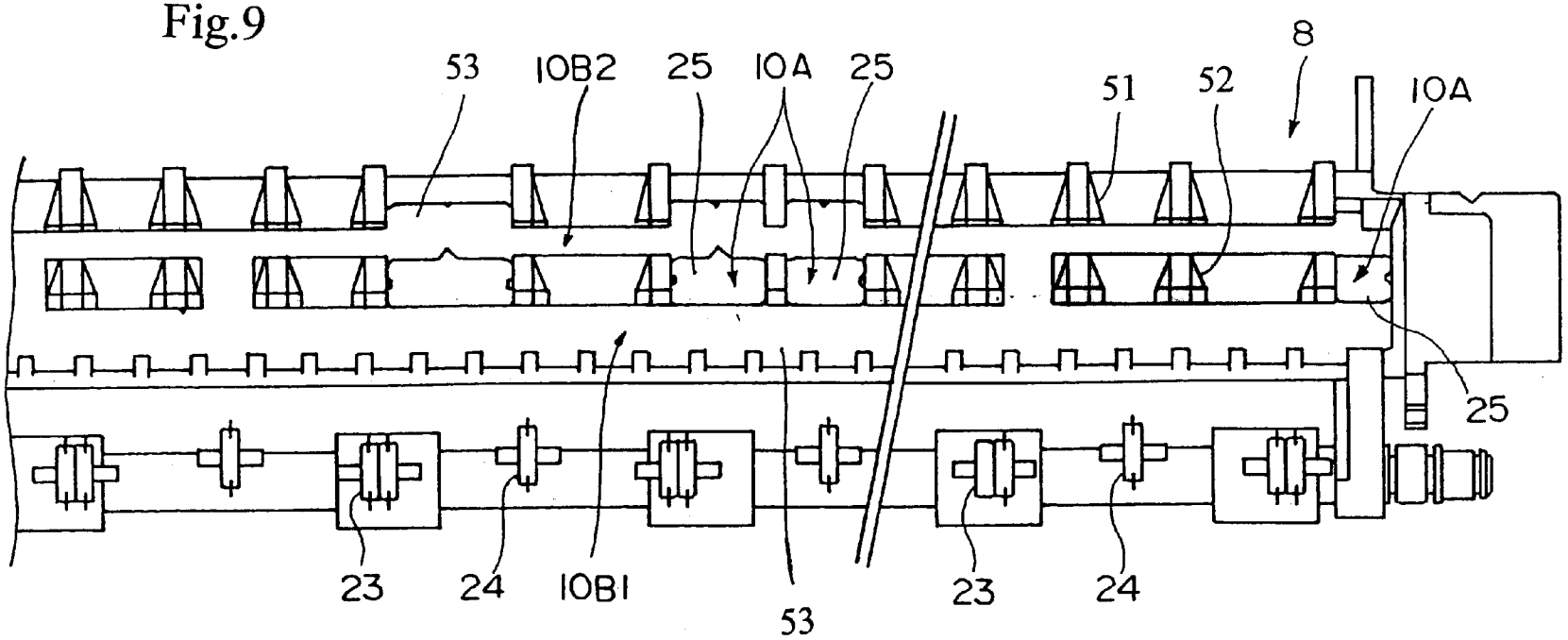
FIG. 9 is a top view showing the construction of the recording medium guide member used in the recording device shown in FIG. 8.
Figure 10:
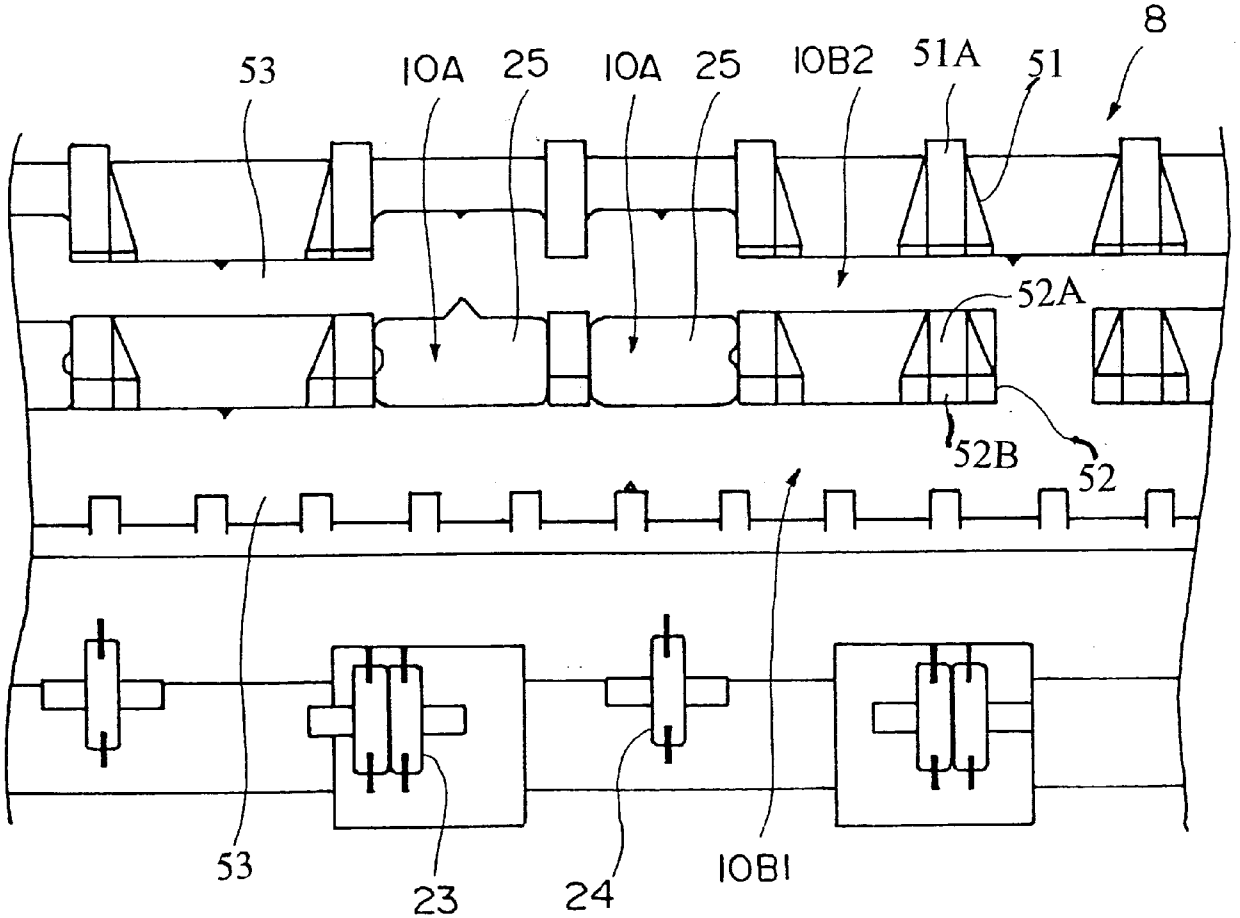
FIG. 10 is a partially enlarged top view of the guide member shown in FIG. 9.

Next, the second embodiment of the inkjet recording device according to this invention is explained based on the working example shown in FIGS. 8 through FIG. 10. The second embodiment of the recording device according to this invention is constructed so that it is able to perform top and bottom margin-free printing in addition to the left and right margin-free printing described above. Thus the basic construction is approximately the same as the recording device shown in FIG. 1.

In other words, in FIG. 8, ink-receiver holes 10A are formed to catch ink discharged by the recording head when performing margin-free printing to the left and right. An ink absorbing material 25 of urethane material, for example, formed into a rectangular block is housed in each ink-receiver hole 10A. The construction of other elements shown in FIG. 8 is the same as the construction shown in FIG. 1, and the same numbers are used for corresponding elements.

The guide member 8 shown in FIG. 8 is shown as a cross-section cut in the longitudinal direction at the placement position of the ink-receiver holes 10A for performing left and right margin-free printing. In this working example, as further shown in FIG. 9 and FIG. 10, ink-receiver holes 10B1, 10B2 are formed to catch ink discharged by the recording head when executing top and bottom margin-free printing.

FIG. 9 and FIG. 10 show the construction of the recording medium guide member 8 shown in FIG. 8. FIG. 9 illustrates a plane view of the guide member omitting part of the longitudinal direction. FIG. 10 shows part of the guide member 8 enlarged.

As stated above, ink-receiver holes 10A are formed on the guide member 8 for the recording medium to receive ink drops discharged by the recording head when executing margin-free printing in the left and right direction of the recording paper, and ink-receiver holes 10B1, 10B2 are formed to receive ink drops discharged by the recording head when executing margin-free printing in the top and bottom direction.

A plurality of protrusions 51, 52 are positioned along the main scanning direction on the upper surface of the guide member 8. These protrusions 51, 52 are positioned in the longitudinal direction of the guide member 8, sandwiching the abovementioned ink-receiver holes 10B2. As shown in FIG. 10, an inclined surface 51*a* that rises along the direction in which the recording paper is conveyed is formed on each of the protrusions 51, which are placed on the upstream side of the recording paper conveying direction.

An inclined surface 52*a* that rises along the direction in which the recording paper is conveyed and an apex surface 52*b* are formed on each of the other protrusions 52. Through this construction, recording paper being sent from the upstream side is scanned over the apex surface 52*a* formed on each of the protrusions 52, and a specific paper gap is formed between the paper and the abovementioned recording head 7.

When executing margin-free printing, the right edge of the recording paper is set with the approximate center of the ink-receiver hole 10A formed on the home position side shown in FIG. 9 (right-hand side in the drawing) as the basic position. The positions of the other ink-receiver holes 10A are determined by the left edge of the recording paper, depending on the size of the paper width, bordering on said ink-receiver holes.

According to this construction, ink discharged from the recording head beyond the left and right edges of the recording paper is captured by the ink-receiver hole 10A formed on the home position side and one of the other ink-receiver holes 10A determined by the paper width.

Further, ink-receiver holes 10B1, 10B2 are each formed along the longitudinal direction of the guide member 8, sandwiching each ink-receiver hole 10A. The ink-receiver hole 10B1, positioned on the downstream side of the recording paper conveying direction, catches ink discharged by the recording head beyond the top edge of the recording paper as said top edge passes through.

The ink-receiver hole 10B2, positioned on the upstream side of the recording paper conveying direction, catches ink discharged by the recording head beyond the bottom edge of the recording paper as said bottom edge passes through.

Also, ink absorbing materials 53 of urethane, for example, formed into parallel crosses are housed within the abovementioned long-length ink-receiver holes 10B1,10B2 that catch ink during top and bottom margin-free printing.

Thus, ink caught by the ink absorbing materials 25, 53 when executing top and bottom as well as left and right margin-free printing on the recording paper drops through an aperture suitably formed on the bottom of the guide member 8 to the discharged liquid absorbing material 14 within the discharged liquid tank 13 positioned below the member.

Drive rollers 23 are positioned along the longitudinal direction on the upper surface of the guide member 8; driven rollers 24, which rotate in contact with the drive rollers 23, are provided. These drive rollers and driven rollers constitute the paper ejecting roller unit, which is constructed to pinch and eject the recording paper being conveyed along the upper surface of the guide member 8.

Through this construction, ink that is discharged in areas beyond the top edge of the recording paper as the top edge of the recording paper passes through during execution of top and bottom margin-free printing will fly toward the ink-receiver hole 10B1. Ink discharged in areas beyond the bottom edge of the recording paper as the bottom edge of the recording paper passes through will fly toward the ink-receiver hole 10B2.

Further, ink discharged in areas beyond the left and right edges of the recording paper when executing left and right margin-free printing will fly toward the ink-receiver hole 10A positioned on the home position side and another ink-receiver hole 10A determined by the recording paper size.

Since the ink-receiver holes house ink absorbing materials 25, 53, the ink is captured and absorbed by said absorbing materials to prevent ink mist being generated. Further, discharged ink that cannot be absorbed and retained by the abovementioned ink absorbing materials 25, 53 housed in the ink-receiver holes 10A, 10B1, 10B2, will drop to the discharged liquid absorbing material 14 housed in the discharged liquid tank 13 placed below.

The recording device having the construction shown in FIG. 8 through FIG. 10 can also count the amount of ink discharged into each ink-receiver hole on the guide member by utilizing the circuit configuration shown in FIG. 5. Since the operation of the circuit configuration shown in FIG. 5 has already been described, the counting operation specific to the performance of top and bottom as well as left and right margin-free printing will be explained below.

The ink-receiver holes 10A, 10B1, 10B2 need not penetrate the guide member 8 in the vertical direction but a closed-bottom construction may also be adopted. If the ink-receiver holes are in closed-bottom form, the amount of ink discharged in each of the ink-receiver holes 11A, 10B1, 10B2 formed on the guide member 8 are counted individually.

In this case, control signals are sent from the abovementioned printing control means 30 to the discharged liquid counting means 39, causing the amount of ink discharged into each of the ink-receiver holes 10A, 10B1, 10B2 to be counted individually.

Each value counted by the discharged liquid counting means 39 is sent to the discharged liquid accumulating counter 40, said counter cumulatively counting the amount of ink discharged into each of the ink-receiver holes 10A, 10B1, 10B2 individually.

In this case, since top and bottom margin-free printing is performed in addition to left and right margin-free printing, the constant shown in "Margin-Free Printing 2" in FIG. 6 is used to count the amount of discharged ink captured in the ink-receiver holes 10B1, 10B2 when executing top and bottom margin-free printing. The constant shown in "Margin-Free Printing 2" in FIG. 6 is the value for a single line.

Thus, in the working example relating to the second embodiment of this invention, the abovementioned discharged liquid counting means 39 counts the amount of ink discharged into each of the ink-receiver holes 10A, 10B1, 10B2 for each carriage pass action, and operates to sequentially send the count for each carriage pass action to the discharged liquid accumulating counter 40.

In this case, cumulative count of discharged ink that is sufficiently satisfactory for practical purposes can be achieved if a constant predetermined for each pass action is sent by the discharged liquid counting means 39 to the discharged liquid accumulating counter 40.

The abovementioned discharged liquid accumulating counter 40 sends the count to the accumulation determining means 41. The accumulation determining means 41 verifies whether or not the count for discharged ink discharged into each ink-receiver hole has reached a specified value.

If it is determined that the amount of discharged ink discharged to the ink-receiver holes has reached a specified value, control signals are sent from the accumulation determining means 41 to the display means 42 and the printing control means 30.

In this case, the abovementioned display means 42 displays a message recommending maintenance such as replacing the ink absorbing material 25 or 53 housed in each ink-receiver hole. Also, the printing control means 30 receives instructions from the accumulation determining means 41 to switch the printing mode so that ink is not discharged into the ink-receiver holes. For example, control is provided so that a normal printing mode with margins on the top and right as well as the left and right sides on the recording paper is adopted. Or control could be provided so that ink is not discharged in areas beyond the left and right edges of the recording medium.

The discharge of ink to the ink absorbing materials 25, 53 housed in each ink-receiver hole can be limited by this means. Thus, contamination of the recording paper by ink, caused by excessive discharged ink accumulated in the ink-receiver holes, can be avoided.

In this case also, the data from the abovementioned discharged liquid accumulating counter 40 can also be utilized by editing on the printer driver in the host computer to display the number of sheets that can be printed in margin-free printing.

The above explanation assumes that the ink-receiver holes are in closed-bottom form. If an aperture is formed on the bottom of the guide member 8 for the ink to drop when executing top and bottom as well as left and right margin-free printing, the discharged liquid accumulating counter 40 operates to add together the amount of ink drops discharged into the ink-receiver holes 10A, 10B1, 10B2, and the amount of discharged liquid absorbed by the discharged liquid absorbing material 14 through the cleaning operation.

The threshold value at which the discharged liquid absorbing material 14 in the discharged liquid tank 13 is filled with discharged ink is set in the accumulation determining means 41 to verify whether or not the discharged ink count has reached the specified value (threshold value).

When it is determined that the count has reached the specified value, control signals are sent from the accumulation determining means 41 to the display means 42, and a message is shown recommending maintenance such as replacement of the discharged liquid absorbing material 14, and replacement, as needed, of the ink absorbing materials 25, 53 housed in the ink-receiver holes.

The discharged liquid absorbing material in the embodiment described above may also be improved so that the ink absorbing materials 25, 53 housed in the ink-receiver holes are formed integrally with the discharged liquid absorbing material 14, as shown in FIG. 7.

Although the table shown in FIG. 6 does not indicate the discharged liquid count when a flushing operation is performed, discharge amount is preferably controlled by setting the constant for a flushing action and sending the count from the discharged liquid counting means 39 to the discharged liquid accumulating counter 40 for each flushing action.

In the examples of the abovementioned first and second embodiments, the discharged liquid accumulating means is constituted to cumulatively count the discharged liquid count for each carriage pass action. However, the discharged liquid accumulating means may be constituted to cumulatively count when the printed recording medium is ejected. Also, it may be constituted to cumulatively count when the power source to the recording device is shut down.

Further, a more rational discharged liquid count may be achieved by providing a plurality of predetermined, specified values corresponding to the sizes of the recording medium to be printed and utilizing these selectively when cumulatively counting the discharged liquid. In this case, the paper size information that is input in the printer driver utility loaded in the host computer may be utilized for information relating to the recording medium sizes.

As is clear from the explanation above, the second embodiment of the inkjet recording device according to this invention has ink-receiver holes to catch ink discharged from the recording head when performing margin-free printing beyond the top, bottom, left, and right margins of the recording medium, and at the same time, ink absorbing materials are housed in said ink-receiver holes; further a discharged liquid accumulating means is provided to cumulatively count the amount of ink drops discharged to the ink absorbing materials so that the amount of discharged ink collected in the ink-receiver holes may be controlled. Thus, the problem of excessive discharged ink collecting in the ink-receiver holes and, for example, contaminating the recording medium can be avoided.

What is claimed is:

1. An inkjet recording device provided with a recording head that is mounted on a carriage and which discharges ink based on printing data, and a recording medium guide member that is placed along the main scanning direction scanned by said carriage and which conveys the recording medium in a subsidiary scanning direction orthogonal to the main scanning direction, wherein the inkjet recording device is characterized by:

having ink-receiver holes for receiving ink discharged from said recording head, said holes being formed on said recording medium guide member in positions beyond the edges of the recording medium being conveyed, as well as having ink absorbing materials placed in said ink-receiver holes, and being provided with a discharged liquid accumulating means that cumulatively counts the amount of ink discharged beyond the edges of the recording medium in one pass of a recording operation into said ink absorbing material.

2. An inkjet recording device provided with a recording head that is mounted on a carriage and which discharges ink based on printing data, and a recording medium guide member that is placed along the main scanning direction scanned by said carriage and which conveys the recording medium in a subsidiary scanning direction orthogonal to the main scanning direction, wherein the inkjet recording device is characterized by:

having ink-receiver holes for receiving ink discharged from said recording head, said holes being formed on said recording medium guide member in positions beyond the left and right edges of the recording medium being conveyed and in positions where the top and bottom edges of the recording medium being conveyed pass, as well as having ink absorbing materials placed in said ink-receiver holes, and being provided with a discharged liquid accumulating means that cumulatively counts the amount of ink discharged beyond the edges of the recording medium in one pass of a recording operation where the top and bottom edges of the recording medium being conveyed pass into said ink absorbing material.

3. An inkjet recording device defined in claim 1 or claim 2, wherein the discharged liquid accumulating means, which cumulatively counts the amount of ink discharged into the ink absorbing materials in said ink-receiver holes, is constituted to execute a cumulative count for each pass action of said carriage.

4. An inkjet recording device defined in claim 3, wherein said discharged liquid accumulating means, when cumulatively counting the amount of ink discharged into the ink absorbing materials in said ink-receiver holes, cumulatively counts a specified value predetermined according to the size of the recording medium to be printed.

5. An inkjet recording device defined in claim 1 or claim 2, so constituted that a predetermined specified value is cumulatively counted for each pass action of said carriage.

6. An inkjet recording device defined in claim 1 or claim 2, wherein the discharged liquid accumulating means, which cumulatively counts the amount of ink discharged into the ink absorbing materials in said ink-receiver holes, is constituted to execute a cumulative count when the recording medium is being ejected.

7. An inkjet recording device defined in claim 1 or claim 2, wherein the discharged liquid accumulating means, which cumulatively counts the amount of ink discharged into the ink absorbing materials in said ink-receiver holes, is constituted to execute a cumulative count when the power source to the recording device is shut down.

8. An inkjet recording device defined in claim 1 or claim 2, provided with an accumulation determining means which verifies that the count made by the discharged liquid accumulating means, which cumulatively counts the amount of ink discharged into the ink absorbing materials in said ink-receiver holes, has reached a specified value, the device being constituted to switch to a printing mode that does not discharge ink into the ink-receiver holes when the accumulation determining means verifies that said specified value has been reached.

9. An inkjet recording device defined in claim 1 or claim 2, provided with an accumulation determining means which verifies that the count made by the discharged liquid accumulating means, which cumulatively counts the amount of ink discharged into the ink absorbing materials in said ink-receiver holes, has reached a specified value, the device being constituted to display a message on the display means when the accumulation determining means verifies that said specified value has been reached.

10. An inkjet recording device defined in claim 1 or claim 2, having, in the gravitational direction below the ink-receiver holes formed on said recording medium guide member, a discharged liquid absorbing material that absorbs and retains discharged ink from a capping means, which seals the nozzle-forming surface of the recording head and provides negative pressure by means of a suction pump, the inkjet recording device being so constituted that ink discharged into said ink-receiver holes can migrate to said discharged liquid absorbing material.

11. An inkjet recording device defined in claim 10, provided with a discharged liquid accumulating means that counts by adding together the amount of ink discharged into the ink absorbing materials in the ink-receiver holes formed on said recording medium guide member and the amount of discharged liquid absorbed by said discharged liquid absorbing material.

12. An inkjet recording device defined in claim 10, provided with an accumulation determining means which verifies that the count made by the discharged liquid accumulating means, which counts by adding together the amount of ink discharged into the ink absorbing materials in said ink-receiver holes and the amount of discharged liquid absorbed by said discharged liquid absorbing material, has reached a specified value, the device being constituted to display a message on the display means when the accumulation determining means verifies that said specified value has been reached.

13. An inkjet recording device defined in claim 10, wherein the ink absorbing materials contained in said ink-receiver holes are integrally formed with the discharged liquid absorbing material that absorbs and retains discharged ink from the capping means.

14. An inkjet recording device comprising:

first and second ink receiver holes, the first and second ink receiver holes disposed on a recording medium guide member in positions beyond the edges of a recording medium being conveyed;

first and second ink absorbing materials placed within the first and second ink receiver holes, respectively; and a control circuit that cumulatively counts a first and a second amount of ink discharged beyond the edges of the recording medium in one pass of a recording operation into the first and second ink receiver holes, respectively, wherein said first and second ink receiver holes are disposed within a recording area.

15. The inkjet recording device according to claim 14, further comprising:

a third ink receiver hole disposed on the recording medium guide member in a position where a top edge of the recording medium being conveyed passes; and a third ink absorbing material placed within the third ink receiver hole, wherein the control circuit cumulatively counts a third amount of ink discharged beyond the edge of the recording medium in one pass of a recording operation where the top edge of the recording medium being conveyed pass into the third ink receiver hole, and further wherein the third ink receiver hole is disposed within a recording area.

16. The inkjet recording device according to claim 15, further comprising:

a fourth ink receiver hole disposed on the recording medium guide member in a position where the bottom edge of the recording medium being conveyed passes; and a fourth ink absorbing material placed within the fourth ink receiver hole, wherein the control circuit cumulatively counts a fourth amount of ink discharged beyond the edge of the recording medium in one pass of a recording operation where the bottom edge of the recording medium being conveyed pass into the fourth ink receiver hole, and further wherein the fourth ink receiver hole is disposed within a recording area.

* * * * *